US007118707B2

(12) United States Patent
Robinson

(10) Patent No.: US 7,118,707 B2
(45) Date of Patent: Oct. 10, 2006

(54) SILVER-PLATINUM ALLOY AND METHODS OF MANUFACTURING SAME

(75) Inventor: Marc Alan Robinson, Hemet, CA (US)

(73) Assignee: American Bullion Investment Company, Inc., Carson, CA (US)

( * ) Notice: Subject to any disclaimer, the term of this patent is extended or adjusted under 35 U.S.C. 154(b) by 158 days.

(21) Appl. No.: 10/815,963

(22) Filed: Mar. 31, 2004

(65) Prior Publication Data

US 2005/0220659 A1 Oct. 6, 2005

(51) Int. Cl.
*C22C 5/08* (2006.01)

(52) U.S. Cl. ..... 420/503; 420/505; 148/430; 148/431

(58) Field of Classification Search ..... 148/430, 148/431; 420/503, 505
See application file for complete search history.

(56) References Cited

U.S. PATENT DOCUMENTS 1,984,225 A * 12/1934 McFarland ..... 420/502
3,748,712 A 7/1973 Karawin

FOREIGN PATENT DOCUMENTS

JP 62054046 * 3/1987
JP 62243725 * 10/1987
JP 10068031 A2 3/1998
JP 2001040438 A2 2/2001

OTHER PUBLICATIONS

JCK Show Flyer, Introducing Silver Select, Las Vegas, Nevada, Jun. 2003.
JCK Magazine, Spotlight Exclusive, David Gomez, Mar. 21, 2003.

* cited by examiner

*Primary Examiner*—Sikyin Ip
(74) *Attorney, Agent, or Firm*—Knobbe Martens Olson & Bear, LLP

(57) ABSTRACT

A silver-platinum alloy formulated to provide improved tarnish resistance and hardness as compared to sterling silver. The alloy can be incorporated in various jewelry, flatware, and like articles. The alloy generally includes silver and platinum, with silver being the predominant component. In certain applications, the alloy includes about 90–95.5% silver and about 0.5–6% platinum. A small amount of gallium can also be added to the composition to provide ease of manufacture of the alloy. The resulting alloy has the favorable properties afforded by sterling silver, but also has brighter surface finish, greater tarnish resistance and increased hardness as compared to traditional sterling silver.

6 Claims, No Drawings

SILVER-PLATINUM ALLOY AND METHODS OF MANUFACTURING SAME

BACKGROUND OF THE INVENTION

1. Field of the Invention

This invention relates generally to metal alloys, and more particularly relates to compositions of certain silver-platinum alloys for use in jewelry and flatware manufacturing.

2. Description of the Related Art

Sterling silver is widely used in the fabrication of jewelry and flatware. It is a metal alloy having a composition typically consisting of at least 92.5% pure silver and about 7.5% copper. Sterling silver is usually provided to jewelry manufacturers in the form of pellet-like shots. The shots can be melted and cast into desired forms using conventional investment casting techniques. Sterling silver is a preferred material for jewelry and flatware largely because silver provides certain desirable properties to the final product, including surface whiteness, malleability, strength, and durability while copper provides other desired properties, such as increased material hardness.

However, one disadvantage associated with sterling silver is that it tends to tarnish easily. It is generally understood that the copper components in the sterling silver alloy tend to react with oxygen to form copper oxide, which typically shows as a darkened area or tarnish in the cast article. Thus, the amount of copper present in the sterling silver alloy can greatly affect the amount of tarnish or blemish appearing on the finished product. In some cases, copper oxide is formed when the sterling silver is still in pellet form, which in turn can cause the tarnish to extend deep into the article during casting and not be easily removed by polishing. In such circumstances, the cast article would have to be scrapped, converted into the elemental metals and then re-alloyed. In view of the foregoing, it will be appreciated that there is a need for an improved silver-based alloy which provides the advantages afforded by sterling silver and yet also has greater tarnish resistance, surface brightness, and increased hardness when compared to sterling silver.

SUMMARY OF THE INVENTION

In one aspect, the preferred embodiments of the present invention provide a silver alloy composition comprising about 90%–95.5% silver and about 0.5–6% platinum by weight. The platinum is preferably used to replace at least some of the copper present in a typical sterling silver alloy and provide the silver alloy with greater light reflectivity and tarnish resistance as compared to a sterling silver alloy that does not incorporate platinum. In one embodiment, the alloy composition further comprises about 0.7–3.2% copper by weight. In another embodiment, the alloy composition further comprises about 1–5% by weight of one or more metal additives, selected from the group consisting of zinc, gallium, silicon, boron, indium, tin, germanium and mixtures thereof. The silver alloy can be used to manufacture jewelry, selected from the group consisting of bracelet, ring, necklace, brooch, cuff links, pin, and watch. The silver alloy can also be used to manufacture a flatware item, selected from the group consisting of knife, fork, spoon, tray, pitcher, and plate.

In certain embodiments, the alloy composition preferably comprises about 92.5% silver and about 1% platinum by weight, with the resulting alloy having a Rockwell-15T Hardness of between about 69–70. In certain other embodiments, the alloy composition preferably comprises about 92.5% silver and about 3.5% platinum by weight, with the resulting alloy having a Rockwell-15T Hardness of about 72. In yet other embodiments, the alloy composition preferably comprises about 92.5% silver and about 5% platinum by weight, with the resulting alloy having a Rockwell-15T Hardness of about 63–64.

In another aspect, the preferred embodiments of the present invention provide a silver alloy comprising silver and platinum, with silver being the predominant component by weight relative to the weight of the alloy. The silver preferably comprises about 92.5% or more silver by weight, and about 0.5% or more platinum by weight. In one embodiment, the composition further comprises less than about 3.5% copper by weight. In another embodiment, the composition further comprises gallium, preferably about 0.3% by weight. In certain embodiments, the silver alloy is formed into a configuration selected from the group consisting of grains, sheets, and tubes.

In yet another aspect, the preferred embodiments of the present invention provide a metal alloy comprising about 90.5–95.5% silver, about 0.5–6% platinum, about 0.7–4% copper, and about 0.1–2% gallium. In some embodiments, the alloy further comprises about 0.5–4% zinc, about 0–0.2% silicon, about 0–0.3% boron and about 0–1.5% indium. In other embodiments, the alloy further comprises about 0–3% tin and about 0–2.5% germanium. The metal alloy can be adapted for use in jewelry manufacturing, flatware manufacturing, and the like. The platinum preferably refines the grain structure of the alloy so as to provide the metal alloy with a brighter surface finish as compared to a sterling silver alloy that does not include platinum.

In yet another aspect, the preferred embodiments of the present invention provide a method of manufacturing a silver-platinum alloy, with silver being the predominant component of the alloy. The method comprises combining silver, platinum, gallium, and additives to form a mixture. Preferably, the gallium facilitates alloying of silver and platinum at a temperature lower than the respective melting temperatures of silver and platinum. The method further includes heating the mixture to melt the components of the mixture and incorporate the components into an alloy. In one embodiment, the method further includes forming the molten alloy into a desired shape and configuration for use in jewelry manufacturing.

In certain embodiments, combining the components to form the mixture comprises (a) placing a first layer comprising silver in a container made of a material that is capable of withstanding high temperatures; (b) placing a second layer comprising zinc and gallium on the first layer; (c) sprinkling a flux material over the second layer; (d) covering the zinc and gallium in the second layer with silver; (e) placing a third layer comprising silicon in the container; and (f) placing a fourth layer comprising platinum on the third layer. In one embodiment, the mixture is heated to a temperature of between about 2300° F. to 2350° F. for between about 5 to 8 minutes to incorporate the metals in the mixture. In another embodiment, the molten alloy can be poured into water to form beads of grain, poured into an ingot mold, formed into a flat sheet or a tube.

DETAILED DESCRIPTION OF THE PREFERRED EMBODIMENT

Preferred embodiments of the present invention provide certain metal alloys that are formulated with a composition that imparts to an article of jewelry, flatware or the like favorable properties afforded by sterling silver, and additionally, also provide greater tarnish resistance, brightness, and increased hardness as compared to sterling silver. In one embodiment, the metal alloy generally comprises silver and platinum, with silver being the predominant component. Predominant component is herein defined as a component that is greater than 50% by weight of the total weight of the alloy. Preferably, both the silver and platinum incorporated are at least 99.5% pure, more preferably about 99.9% pure.

In one embodiment, the alloy comprises between about 90.5%–95.5% silver and between about 0.5%–6% platinum by weight. Preferably, at least a portion of the copper typically present in a sterling silver alloy is replaced with platinum so as to reduce the amount of tarnish from copper while at the same time utilize platinum to improve the hardness, brightness and other qualities of the alloy. In particular, platinum is a tarnish resistant precious metal that can improve the tarnish resistance of the silver alloy. Platinum also increases the specific gravity and weight of the alloy to greater than that of traditional sterling silver, thereby giving the jewelry a heavier feel. The addition of platinum to a silver alloy also enhances the intrinsic value of the alloy as platinum is generally known to be a much more expensive precious metal.

In certain embodiments, the silver alloy also includes a reduced amount of copper, preferably less than about 2%–3.5% by weight, more preferably between about 1% to 3.5% copper. Keeping the copper percentage at about 3.5% or less substantially reduces formation of tarnish on the finish. In other embodiments, the alloy further comprises trace amounts of gallium, preferably between about 0.1–2% by weight. Gallium, having a desired white color itself, is a suitable component of the alloy as its properties allow it to mix easily with other metals in the alloy. Gallium also lowers the overall melting temperature of the alloy significantly as will be described in greater detail below. Gallium, when added to the platinum and silver, also produces a sheen or a hue in the finished polished pieces that is different from polished traditional sterling, polished platinum jewelry, 10-14-18 karat white gold or any other white metal used in jewelry.

In other embodiments, the alloy further comprises metal additives selected from the group consisting of zinc, indium, silicon, boron and mixtures thereof. Both zinc and silicon have anti-tarnish and anti-corrosion qualities and zinc, in particular, also helps the workability of the alloy and makes it more forgiving in the manufacturing process for jewelry. In one embodiment, the alloy composition further comprises about 1.1%–2.6% zinc, 0.1% indium, 0.1% silicon, and 0.1% boron by weight. In another embodiment, the alloy composition further comprises about 0–3% tin and about 0–2.6% germanium.

Table 1 below provides silver-platinum alloy formulations of certain preferred embodiments of the present invention:

TABLE 1

| | Formulation 1 | Formulation 2 | Formulation 3 |
|---|---|---|---|
| Silver (Wt. %) | about 90.5–95.5 (preferably about 92.5%) | about 90.5–95.5 (preferably about 92.5%) | about 90.5–95.5 (preferably about 92.5%) |
| Platinum (Wt. %) | about 0.5–2 (preferably about 1%) | about 3–4.5 (preferably about 3.5%) | about 4.5–6 (preferably about 5%) |
| Copper (Wt. %) | about 3–4 | about 1–2.5 | about 0.9–1.5 |
| Zinc (Wt. %) | about 2–3 | about 1–2.5 | about 0.9–1.5 |
| Gallium (Wt. %) | about 0.1–0.35 | about 0.1–0.35 | about 0.1–0.35 |
| Silicon (Wt. %) | about 0.075–0.15 | about 0.075–0.15 | about 0.075–0.15 |
| Boron (Wt. %) | about 0–0.2 | about 0–0.2 | about 0–0.2 |
| Indium (Wt. %) | about 0–0.2 | about 0–0.2 | about 0–0.2 |

Table 2 below provides formulation of silver-platinum composition of another embodiment of the present invention.

TABLE 2

| | |
|---|---|
| Silver (Wt. %) | about 90–95.5% |
| Platinum (Wt. %) | about 0.5–6% |
| Copper (Wt. %) | about 0.7–4% |
| Zinc (Wt. %) | about 0.5–4% |
| Gallium (Wt. %) | about 0.1–2% |
| Silicon (Wt. %) | about 0–0.2% |
| Boron (Wt. %) | about 0–0.3% |
| Indium (Wt. %) | about 0–1.5% |
| Tin (Wt %) | about 0–3% |
| Germanium (Wt %) | about 0–2.6% |

The silver-platinum alloy of the preferred embodiments described above can be formed into various shapes and sizes for jewelry manufacturing. The alloy can be formed into grains, sheets, wires, and tubing for various applications. However, one challenge in manufacturing an alloy incorporating both silver and platinum is that the melting temperatures of the metals are widely different. Platinum melts at about 3200° F. while silver melts at about 1640° F. Furthermore, the time it takes for a metal to fully melt and liquefy, and conversely, the time it takes for a metal to fully solidify, otherwise known as the pasty ranges, are narrow for both platinum and silver. Additionally, it is generally not desired for the end jewelry manufacturing temperatures to be too high in order to ensure the ease of manufacture with basic equipment. Thus, it is desired to keep the alloy temperature as low as possible and the pasty ranges wider and longer.

Certain preferred embodiments of the present invention provide methods of producing the metal alloy incorporating both silver and platinum that take into account of the wide range of melting temperatures and narrow pasty ranges. In one embodiment, gallium is added to the alloy to bring the melting and manufacturing temperatures down to a more reasonable level and help keep the pasty range wide. Gallium melts at about 85.5° F. or room temperature. Keeping the temperature of the silver-platinum alloy down to a more reasonable level allows the manufacturer to use conventional, basic equipment for casting without having to acquire specialized machinery to accommodate the working with platinum. Platinum casting in jewelry historically takes special platinum equipment outside of regular casting machinery used for gold, silver, brass, and bronze.

Gallium also has one of the largest temperature ranges of all metals (87.5° F. melt to 3,999° F. boil). Thus, in the alloying of the high temperature platinum with the low temperature silver, gallium helps to incorporate these metals more thoroughly at a more reasonable alloying temperature. Gallium incorporates with almost any metal and helps some metals to bond with others. The casting of the new alloy has been performed at normal ranges of temperature, about 900° F.–1,100° F. flash temperature and about 1,850° F.–1,900° F. metal temperature, using conventional casting and finishing equipment and the finishing has process has been relatively easy and trouble free.

A preferred method of manufacturing the silver-platinum alloy described above includes placing a desired amount of pure silver, preferably greater than or equal to about 92.5%, into a crucible made from graphite, silicon carbide or ceramic materials. Then the other metals in the formulation are subsequently placed into the crucible. Preferably, there is a specific order or layering of these metals when loading the crucibles. For example, in some embodiments, the zinc and gallium are laid down first. Indium is then added. A tiny pinch of flux (about ⅛ teaspoon of 75% Borax and 25% Boric Acid powder) is sprinkled over the mixture. A small amount of fine silver is then put in only to cover both the zinc and the gallium. Then the silicon, copper and platinum are added. The remaining balance of the fine silver is placed on top.

The metals contained in the crucible are then loaded into a melting device. Normally with traditional sterlings, the method of melting or equipment used is not specific because of the nominal temperatures needed to be generated to complete the alloying successfully. However, with the addition of platinum to the composition with its high melting temperature of over 3000° F., a high frequency melting device that is capable of attaining the higher temperatures needed to incorporate the platinum into the other metals completely is needed in certain embodiments. In some embodiments, a hydrogen/oxygen torch can be used. In other embodiments, a standard electric muffle furnace or a gas/air blast furnace can be used.

The metals in the crucible are subsequently heated to a temperature of about 2300 F., preferably no more than 2350 F. The metal preferably stays at the temperature for at least 5 minutes and no more than 8 minutes to thoroughly incorporate all the metals including the platinum. During this time, it is advisable to stir the melt manually several times with a stir rod. In some embodiments, a "cover gas" should be employed while the metal is molten. The cover gas can include argon, nitrogen, or forming gas, which is comprised of 25% hydrogen and about 75% nitrogen. This cover gas keeps oxygen out of the molten metal and helps to incorporate the zinc and the gallium into the alloy more thoroughly. The metal is then poured into water to form little beads of grain, or poured into an ingot mold. The product is then ready to be used in manufacturing. No further alloying or processing is needed, however tumbling of the alloy grain is recommended to give it a high gloss polished look.

In certain embodiments, platinum is used as an additive to act on the silver as a grain refiner. A grain refiner tightens the molecules of the alloy and thus provides a brighter and superior surface finish. Moreover, the gallium also tightens the grain structure by helping to bond the metals together. Bonding the metals is one of the attributes of adding gallium. Gallium, together with the platinum grain refiner, gives the platinum/silver alloy a brighter and superior surface finish.

Although the foregoing description of the preferred embodiments of the present invention has shown, described and pointed out the fundamental novel features of the invention, it will be understood that various omissions, substitutions, and changes in the form of the details of the invention as illustrated as well the uses thereof, may be made by those skilled in the art, without departing from the spirit of the invention. Consequently, the scope of the invention should not be limited to the foregoing discussions.

What is claimed is:

1. A metal alloy having a composition consisting essentially of 90.5–95.5% silver by weight, about 0.5–6% platinum by weight, about 0.7–4% copper by weight, about 0.1–2% gallium by weight, about 1–3% tin by weight, about 1–2.5% germanium by weight, about 0.5–4% zinc by weight, and about 0.1–0.2% silicon by weight.

2. A jewelry item comprising the alloy composition of claim 1, said jewelry item is selected from the group consisting of bracelet, ring, necklace, brooch, cuff links, pin, and watch.

3. A flatware item comprising the alloy composition of claim 1, said flatware item is selected from the group consisting of knife, fork, spoon, tray, pitcher and plate.

4. The alloy of claim 1 is formed into a configuration selected from the group consisting of grains, sheets, and tubes.

5. The metal alloy of claim 1, wherein said platinum refines the grain structure of the alloy so as to provide the metal alloy with a brighter surface finish as compared to a sterling silver alloy that does not include platinum.

6. The metal alloy of claim 1, having a Rockwell-15T Hardness value of between about 69–70.

* * * * *